United States Patent [19]

Donnelly

[11] Patent Number: 5,028,075

[45] Date of Patent: Jul. 2, 1991

[54] FIELD BLUEPRINT CARRIER

[76] Inventor: Dana M. Donnelly, 11079 E. Emery Rd., South Wales, N.Y. 14139

[21] Appl. No.: 553,237

[22] Filed: Jul. 16, 1990

[51] Int. Cl.[5] ..... B42F 3/00

[52] U.S. Cl. ..... 281/49; 281/15.1; 281/45; 281/47; 248/451

[58] Field of Search ..... 281/45, 15.1, 46, 47, 281/48, 49, 51; 40/642, 359, 530, 537, 544; 434/365; 211/45, 89; 248/451, 452, 453; 402/4

[56] References Cited

U.S. PATENT DOCUMENTS

| | | | |
|---|---|---|---|
| 2,711,909 | 6/1955 | Duffie | 281/45 |
| 3,643,363 | 2/1972 | Biro | 281/45 |
| 3,645,561 | 2/1972 | Kendall | 281/45 |
| 4,014,508 | 3/1977 | Weiss | 248/451 |
| 4,157,626 | 6/1979 | Bedinghaus | 281/45 |
| 4,157,875 | 6/1979 | Smith et al. | 402/4 |
| 4,243,249 | 1/1981 | Goss | 281/51 |
| 4,444,418 | 4/1984 | Goldstein | 281/45 |
| 4,530,175 | 7/1985 | Wellman | 40/530 |
| 4,628,572 | 12/1986 | Chang | 281/45 |
| 4,645,163 | 2/1987 | Zovar | 281/45 |
| 4,883,381 | 11/1989 | Pisciotti et al. | 281/15.1 |
| 4,913,463 | 4/1990 | Tlapek et al. | 281/49 |

*Primary Examiner*—Douglas D. Watts
*Assistant Examiner*—Hwei-Siu Payer
*Attorney, Agent, or Firm*—Saperston & Day

[57] ABSTRACT

A portable carrier for containing, using and displaying blueprints in an outdoor working environment includes an expandable living hinge along the centerline of a planar folio with integral handles and closure devices specifically configured restraining clamps to lock large-sized blueprints in place. The folio can thus be laid flat or posted on a wall for use in the field or folded and carried in convenient fashion using the closures and the handles and closure.

9 Claims, 1 Drawing Sheet

Fig. 1.
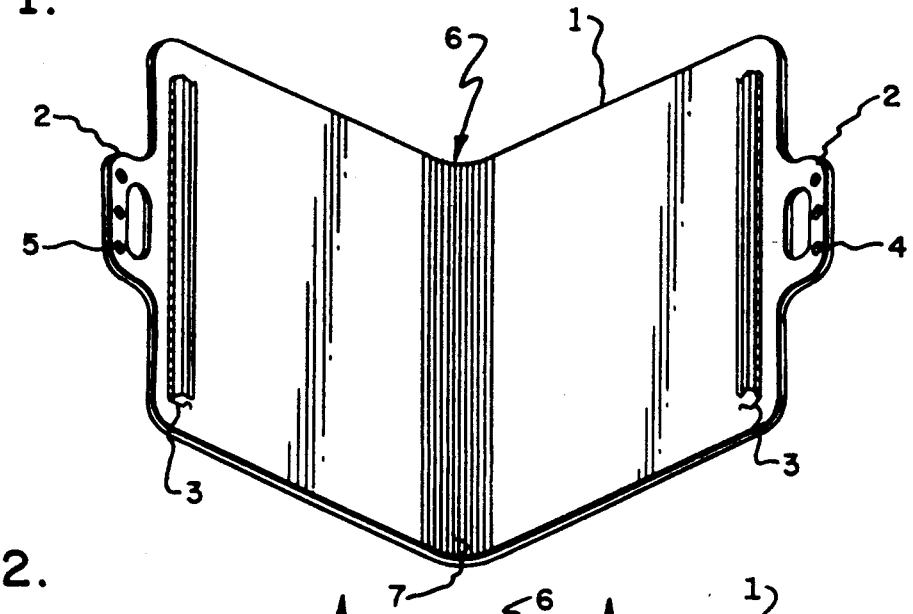
Fig. 2.
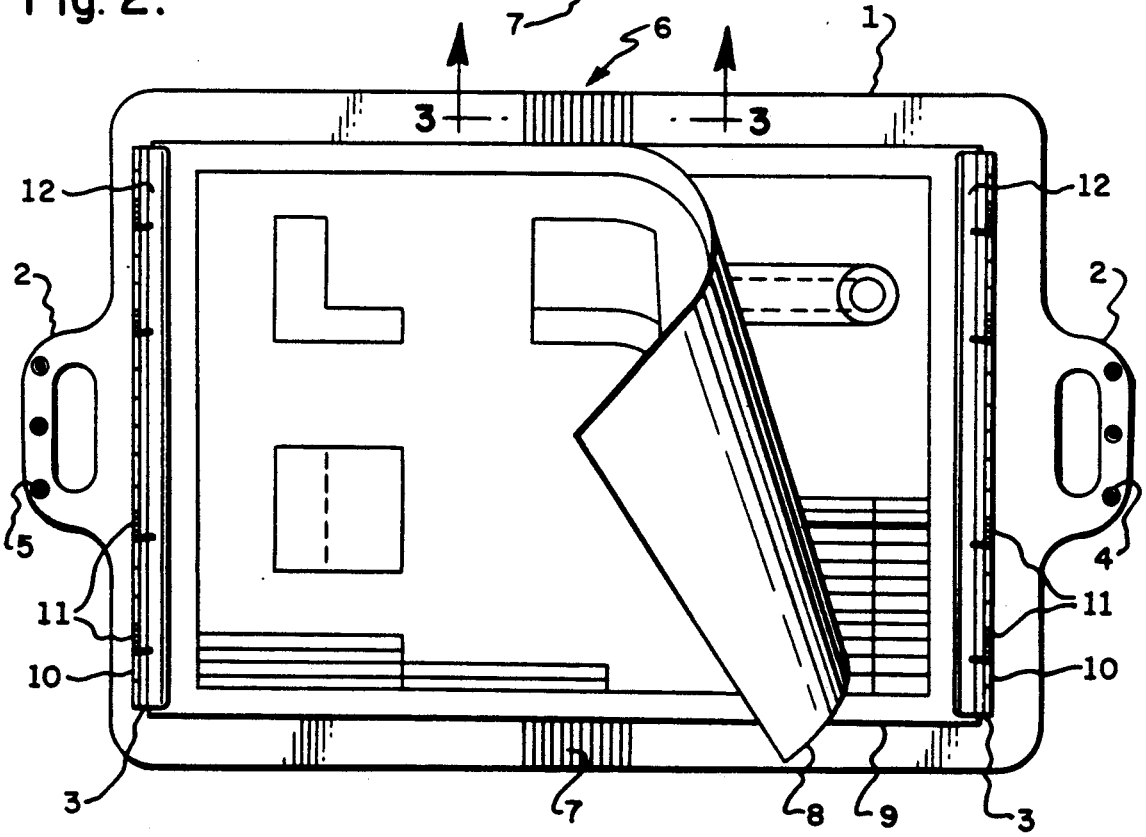
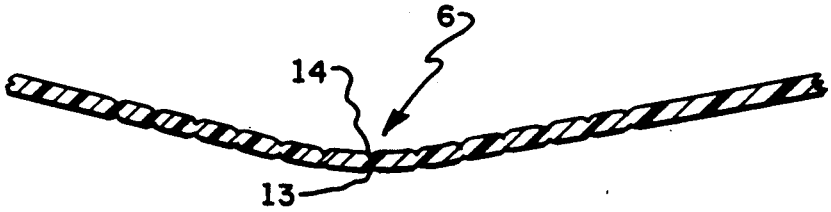
Fig. 3.

FIELD BLUEPRINT CARRIER

FIELD OF INVENTION

A type of folio for carrying papers is presented, and particularly adapted to the difficult problem of transporting and displaying large-sized blueprint drawings in outdoor or indoor working environment.

BACKGROUND OF INVENTION

While there have been many briefcase and clipboard style devices conceived for special purposes, the difficult problem of containing and displaying of blueprint drawings in a working environment has not been effectively addressed. Blueprints, which can be as large as 2 or 3 feet wide and 3 or 4 feet long, can be unwieldy documents, and the customary way of carrying them is to roll a package of drawings up into a tube-shape length secured by a strap or rubber bands. This makes handling the documents very difficult in the hostile outdoor or indoor environment, perhaps in windy conditions, as a flat surface must be found to roll out the documents. The blueprints must be restrained from their tendency to roll back up again either by being held down manually or by being weighted at the corners. These difficulties are compounded when the blueprints must be carried from one portion of the working site to another and used by various personnel on a construction project.

As the number of blueprints on a large construction project is also large, carrying the blueprints together in a large package prevents difficulties of keeping them organized as well as the difficulties of displaying in a flat fashion. The bundles of documents tend to become separated and inconvenient to collect, collate and carry away at the end of a working day on a construction site.

The within invention seeks to address these problems by providing a specifically configured carrying folio that will accommodate large and small sizes, restrain the blueprint documents from their tendency to curl or flutter in hostile weather conditions, and further provide a means of conveniently transporting large numbers of documents in an organized fashion. The construction of the device described herein has become possible with the development and commercialization of modern materials and manufacturing methods that would not have been possible in earlier times. Thus it is an objective of the within invention to provide a means of carrying large and small blueprint documents conveniently.

A further objective of the invention is to accommodate either small numbers or large thicknesses of documents in a carrier that will accommodate these variations.

Yet another objective of the within invention is to provide a carrier that can also serve as a display surface for maintaining the blueprints in a flat configuration on the work site.

A further objective of this invention is to securely retain the blueprint documents yet enable use of multiple documents without losing or removing other documents in the stack.

A final objective of the within invention is to provide a display surface that has sufficient rigidity to be posted on a vertical surface for a convenient working display at a construction site. These and other objectives are achieved by the specifically configured folio described herein.

SUMMARY OF INVENTION

A large rigid display board is sized to completely contain and display a typically dimensioned blueprint document in addition to a border surrounding the document. A hinge is provided down the vertical centerline of the board and handles are molded or otherwise attached at the horizontal edges that can be brought together as the entire board is folded along the centerline hinge. The hinge itself is a flat-lying hinge constructed as illustrated as a "living hinge" integrated with the board material itself, which can be a sheet of polyurethane material, or a plastic-covered fiberboard material. Elongated spring clamps are provided at the vertical edges of the rectangular board and extending substantially along the entire vertical dimension of the blueprint documents. Both the clamps and the hinge provide a variable capacity such that different thicknesses of document stacks can be contained, carried and displayed on the device.

BRIEF DESCRIPTION OF THE DRAWINGS

FIG. 1 is perspective view of the field blueprint carrier, showing the carrier in the half-open position.

FIG. 2 is a plan view of the field blueprint carrier in its full open position, and showing a set of blueprints contained within the interior of the carrier.

FIG. 3 is a partial section along line 3—3 of FIG. 2, showing the construction of the living hinge of the carrier.

DETAILED DESCRIPTION OF THE DRAWINGS

The complete construction of the field blueprint carrier can be seen in FIG. 1, a perspective view of the carrier in a partly open position.

For several reasons described previously, the carrier is most advantageously constructed of a single, semi-rigid sheet 1 which extends to form handles 2 at the right and left edges of the sheet and various functional fittings attach to the sheet, such as transverse, spring-like clamps 3 and closing devices at the right and left edges to secure the carrier in closed position. The closing devices as shown here at the upper extension of the handles are shown as male snap members 4 and female snap members 5. Other closures such as clasps or velcro TM could easily be substituted for the snaps shown. The entire sheet may be folded along a centerline midway between the handle edges and illustrated as a living hinge 6. A living hinge is a construction commonly found in bendable containers and products in recent years as new, flexible, and durable plastics and polymer compositions have been developed. As shown, the living hinge consists merely of an expanse of the material to be folded, scored by numerous lines 7 parallel to the axis of the fold, the actual number of lines depending on the desired radius of curve of the folded material and the thickness and flexibility of the material. Thus, the device shown could be suitable constructed out of a plastic or a polyethylene material, for instance, with sufficient tearing resistance to withstand repeated folding and unfolding along the axis of the living hinge, while at the same time maintaining sufficient rigidity to support the blueprints which are to be carried to the rugged outdoor environment, as well as indoor uses. Thus, the construction material must be selected for a balance of sufficient rigidity to support the contained comments, sufficient durability to withstand tearing, and sufficient flexibility to be able to fold and to conform to varying thicknesses of material contained within, as new materials with the desired blend of characteristics and transparency have become recently available.

FIG. 2 illustrates further features of the construction and advantages of the device in operation, and shows the carrier in full open flat position containing a quantity of blueprints to be used in the field. It is common practice to carry large-size blueprints which are generally 24 inches by 36 inches and can consist of a complex construction project of dozens of pages, in a rolled tube, perhaps secured with a rubber band. As the pages are moderately heavy paper, they will have a tendency to roll back up again when spread out flat to be viewed and used on a construction site, and that inconvenient tendency can be made worse by windy conditions and other discomforts of inclement weather. The construction of the displayed device avoids these problems by providing a complete semi-rigid support 1, at least as large as the blueprint sheets and preferably somewhat large to provide a margin or border around the sheets. FIG. 2 shows a plurality of blueprint-size sheets as contained on the carrier, consisting of a top sheet 8 curled back to reveal a second sheet 9 underneath. Both sheets are secured at the left edge under the spring clamp 3 which can be further seen to consist of a piano hinge 10, spaced coil springs 11 which can be seen as a protruding end over the top clamp member 12 and biasing the top clamp member against the body of the carrier. Although unitary elongated clamps are shown, other configurations of holding devices, such as a row of two or three smaller spring clamps, could easily be substituted. The right edge of the second sheet of the blueprints is also secured at its right side under the other spring clamp and is restrained in the convenient, secure, completely flat viewing and working position. The top sheet would also be secured under the right edge position to be carried, but as the right spring clamp can be lifted to release one edge, the top sheet is still restrained at the left edge for folding back the top sheet without losing it or allowing it to flap in the breeze and obstruct use of the other prints. Of course, the device can also be used in the field to display another set of prints by removing the entire set contained as shown in FIG. 2, rolling it as, putting it aside, and rolling the new set into the spring clamp retainers, which will securely hold them in similar flat position, eliminating entirely the tendency of the rolled sheets to curl up inconveniently.

In the flat position containing the blueprints, the carrier has further utility in the field by being able to be displayed by affixing it to a wall or to an easel, and by its ability to be quickly folded in half, containing the entire set of blueprints and transported to another location on the construction site. It can be seen in this view that no matter what thickness of prints are contained within the carrier, the entire assemblage will remain symmetrical, such that folding along the centerline of the living hinge 7 will bring the handles 2 together in order that the fastening devices on each of the handles will precisely meet for secure closure and carrying of the entire assemblage. While the snap devices 4 and 5 are shown, the closure, of course, could be any secure mating device, such as fabric hook-and-loop fasteners, buttons, lock screws, or no fastening device at all, relying on the user's hand through the hand grips to hold the carrier in closed position. Similarly, the retaining spring clamp shown could consist of variations of releasable, retaining devices that would suitable secure a substantially continuous portion of the edge of the contained blueprints, such as a series of small clamps or a releasable, semi-rigid bar. While the sheet material 1 is shown as a single, flat plane in the extended position, the sheet could also include formed ridges extending out of that plane at the outer edges of the sheet, such that in the closed position the ridges would mate and further secure the contents from exposure to weather in the closed position. With the addition of that element, however, it is important that the entire structure remains substantially a flat, extended sheet as shown, in order to maximize its utility in the field and the achievement of the identified objectives.

FIG. 3 is a partial cross-section to illustrate the construction of the living hinge 6, shown in FIGS. 1 and 2. The cross-section shows the continuity of the sheet material and thus its strength and resistance to tearing or separation if composed of a material with suitable lateral integrity, while bending the material to an extreme degree is enabled by a series of score lines 13 on the surface of the material to the outside in the folded configuration. Score lines 14 to the inside of the material in the folded configuration may also, optionally, be incised to enhance the bendability of the material, especially if it tends more to be rigid than flexible. While the spacing of the parallel score lines can vary greatly depending on the rigidity, thickness, and desired radius of curve of the folded hinge, it has been found by experimentation that a distance of at least twice the thickness of the material between the score lines is desirable and functions well. It may also be seen that with suitable rigidity of the material that different radiuses of the folded hinge may be achieved depending on the thickness of the material contained within the carrier, and in fact, the carrier can accommodate a great thickness of contained blueprints if a sufficient width of parallel score lines are provided, and if a very great thickness of material is to be carried, of course, additional maximum capacity of the spring clamps may also be provided to accommodate thick sheets of documents.

Other uses and applications for the construction of this invention can easily conceived, but its detail and objectives have been specifically and purposely adapted for the carrying of architectural blueprints to a rugged, outdoor construction site environment.

Having thus described the within invention, I claim:

1. A document carrier comprising:

a rectangular sheet of substantially rigid material;

said sheet shaped and dimensioned to be approximately the size of at least one documents contained plus a substantial border around the contained documents;

said sheet of material incorporating a hinge along a centerline of said sheet parallel to opposing edges of said sheet;

said hinge being formed of a portion of said sheet of material made more flexible relative to the substantially rigid portions of the sheet such that the rectangular sheet will be divided by the centerline hinge into right and left substantially rigid covers that are foldable at the hinge;

the outer edge of each said cover being shaped and formed into a handle such that when said covers are folded the handles will be brought together in carrying position; and a pair of document fastener means sized to approximately the full width of the document to be carried within the carrier and placed at each said outer edge inward of said handles and facing inward toward the hinge.

2. The device of claim 1 wherein said handles further include closure devices to fasten said handles together wherein the carrier is in folded position.

3. The device of claim 1 wherein said hinge further comprises score lines in said material parallel to said centerline and extending the full width of said sheet of material, the depth of said score lines being less than half the thickness of the material.

4. The device of claim 3 further comprising score lines on both sides of the hinge section.

5. The device of claim 1 wherein the fastener means further comprises a biased clamp hinged at one side and open on the other, the open side placed facing inward toward the center of said carrier.

6. The device of claim 5 wherein said clamps are biased by a spring.

7. The device of claim 5 wherein said clamps are composed of a semi-rigid material and are biased by deformability of said material.

8. A field blueprint carrier comprising:

a rectangular sheet of semi-rigid material sized to completely contain a blueprint and foldable along a flexible section of said sheet on the centerline parallel to the two short edges of the rectangle;

clamp means to securely hold at least two edges of the blueprint; and handle means extending approximately at the center of the outer short edges of the rectangle.

9. A document carrier comprising:

a single rectangular sheet of material scored along one centerline to be foldable along said centerline;

clamping means parallel to said centerline to clamp at least two edges of a document; and means to fasten together the edges parallel to the hinge when said carrier is folded.

* * * * *